US009383696B2

(12) United States Patent
Nojima et al.

(10) Patent No.: US 9,383,696 B2
(45) Date of Patent: Jul. 5, 2016

(54) FIXING DEVICE

(71) Applicant: CANON KABUSHIKI KAISHA, Tokyo (JP)

(72) Inventors: Koji Nojima, Abiko (JP); Kota Aoki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/663,728

(22) Filed: Mar. 20, 2015

(65) Prior Publication Data

US 2015/0268605 A1 Sep. 24, 2015

(30) Foreign Application Priority Data

Mar. 24, 2014 (JP) ..... 2014-060013

(51) Int. Cl.
*G03G 15/20* (2006.01)

(52) U.S. Cl.
CPC ..... *G03G 15/2053* (2013.01); *G03G 15/2017* (2013.01)

(58) Field of Classification Search
CPC ..... G03G 15/2017; G03G 15/2053
See application file for complete search history.

(56) References Cited

U.S. PATENT DOCUMENTS

| | | | |
|---|---|---|---|
| 7,539,449 | B2 | 5/2009 | Aoki |
| 7,589,300 | B2 | 9/2009 | Nojima |
| 8,139,995 | B1 | 3/2012 | Fujita et al. |
| 8,781,364 | B2 | 7/2014 | Fukuda et al. |
| 8,843,042 | B2 | 9/2014 | Nawa et al. |
| 8,843,046 | B2 | 9/2014 | Nawa et al. |
| 8,918,044 | B2 | 12/2014 | Takematsu et al. |
| 2013/0279956 | A1 | 10/2013 | Aoki |
| 2014/0086616 | A1 | 3/2014 | Nojima et al. |
| 2014/0086617 | A1 | 3/2014 | Nojima |
| 2014/0178091 | A1 | 6/2014 | Sugiyama et al. |
| 2015/0086234 | A1 | 3/2015 | Aoki |

FOREIGN PATENT DOCUMENTS

| | | |
|---|---|---|
| JP | 2010-217580 A | 9/2010 |
| JP | 2011-112708 A | 6/2011 |

OTHER PUBLICATIONS

U.S. Appl. No. 14/663,715, filed Mar. 20, 2015.

*Primary Examiner* — Erika J Villaluna
(74) *Attorney, Agent, or Firm* — Fitzpatrick, Cella, Harper & Scinto

(57) ABSTRACT

A fixing device includes: first and second rotatable members configured to heat-fix, at a nip therebetween, a toner image formed on a sheet by using a toner containing a parting agent; a heating portion, provided opposed to an outer surface of the first rotatable member, configured to heat the first rotatable member through electromagnetic induction heating; a holding portion configured to hold the heating portion; and a suppressing portion configured to suppress air flow in a space between the first rotatable member and the holding portion. The suppressing portion extends from the holding portion toward the first rotatable member and is provided so that a free end portion thereof is in a position of 0.5 mm or more and 3.5 mm or less from the outer surface of the first rotatable member.

19 Claims, 13 Drawing Sheets

FIXING DEVICE

FIELD OF THE INVENTION AND RELATED ART

The present invention relates to a fixing device for fixing a toner image on a sheet. This fixing device is mountable in an image forming apparatus, such as a copying machine, a printer, a facsimile machine or a multi-function machine having a plurality of functions of these machines.

In a conventional image forming apparatus of an electrophotographic type, the toner image is formed on the sheet by using a toner in which a parting agent (wax) is incorporated, and then is fixed under heat and pressure in the fixing device.

It has been known that during the fixing, the wax incorporated in the toner is vaporized and immediately thereafter is condensed. The inventors have found that in the neighborhood of a fixing member of the fixing device, the condensed wax (particles of several nm to several hundred nm, hereinafter also referred to as dust) is present and suspended in a large amount. When no means is provided to prevent such condensed wax immediately after the condensation, most of the wax is diffused to the outside of the fixing device, so that there is a risk that the image is adversely affected. Therefore, it has been required to increase the particle diameter of the wax immediately after the condensation so as not to be diffused to the outside of the fixing device.

On the other hand, in a fixing device of an electromagnetic induction type described in Japanese Laid-Open Patent Application (JP-A) 2010-217580, in order to prevent the wax from being fixed and deposited on a coil holder, a heat generating member is provided in the neighborhood of the coil holder. Specifically, the wax is liquefied by heating the coil holder by the heat generating member, so that the wax fixed on the coil holder is dropped downward.

Further, in a fixing device described in JP-A 2011-112708, when fine particles deposited on a fixing roller are removed by a cleaning web, a trapping material for trapping the fine particles is contained in the cleaning web.

However, in the fixing devices described in JP-A 2010-217580 and JP-A 2011-112708, the dust present in a large amount in the neighborhood of the fixing member cannot be suppressed from being diffused as it is to the outside of the fixing devices, and therefore the means therein do not constitute a solution to this problem.

SUMMARY OF THE INVENTION

According to an aspect of the present invention, there is provided a fixing device comprising: first and second rotatable members configured to heat-fix, at a nip therebetween, a toner image formed on a sheet by using a toner containing a parting agent; a heating portion, provided opposed to an outer surface of the first rotatable member, configured to heat the first rotatable member through electromagnetic induction heating; a holding portion configured to hold the heating portion; and a suppressing portion configured to suppress air flow in a space between the first rotatable member and the holding portion. The suppressing portion extends from the holding portion toward the first rotatable member and is provided so that a free end portion thereof is in a position of 0.5 mm or more and 3.5 mm or less from the outer surface of the first rotatable member.

According to another aspect of the present invention, there is provided a fixing device comprising: first and second rotatable members configured to heat-fix, at a nip therebetween, a toner image formed on a sheet by using a toner containing a parting agent; a heating portion, provided opposed to an outer surface of the first rotatable member, configured to heat the first rotatable member through electromagnetic induction heating; a holding portion configured to hold the heating portion; and an extended portion configured to extend from the holding portion toward the first rotatable member so that a free end portion thereof is positioned in a neighborhood of a surface of the first rotatable member. A gap between the extended portion and the first rotatable member is G (mm) and a peripheral speed of the first rotatable member is V (mm/s), the following relationship is satisfied:

$$0.5 \leq G \leq 0.0059 \times V + 0.72.$$

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of a fixing device according to the present invention will be specifically described below. Incidentally, unless otherwise specified, within a scope of concept of the present invention, constitutions of various devices can be replaced with other constitutions.

<Embodiment 1>

(1) General Structure of Image Forming Apparatus

Before a description of the fixing device is provided, first, the general structure of an image forming apparatus will be described.

Figure 3:
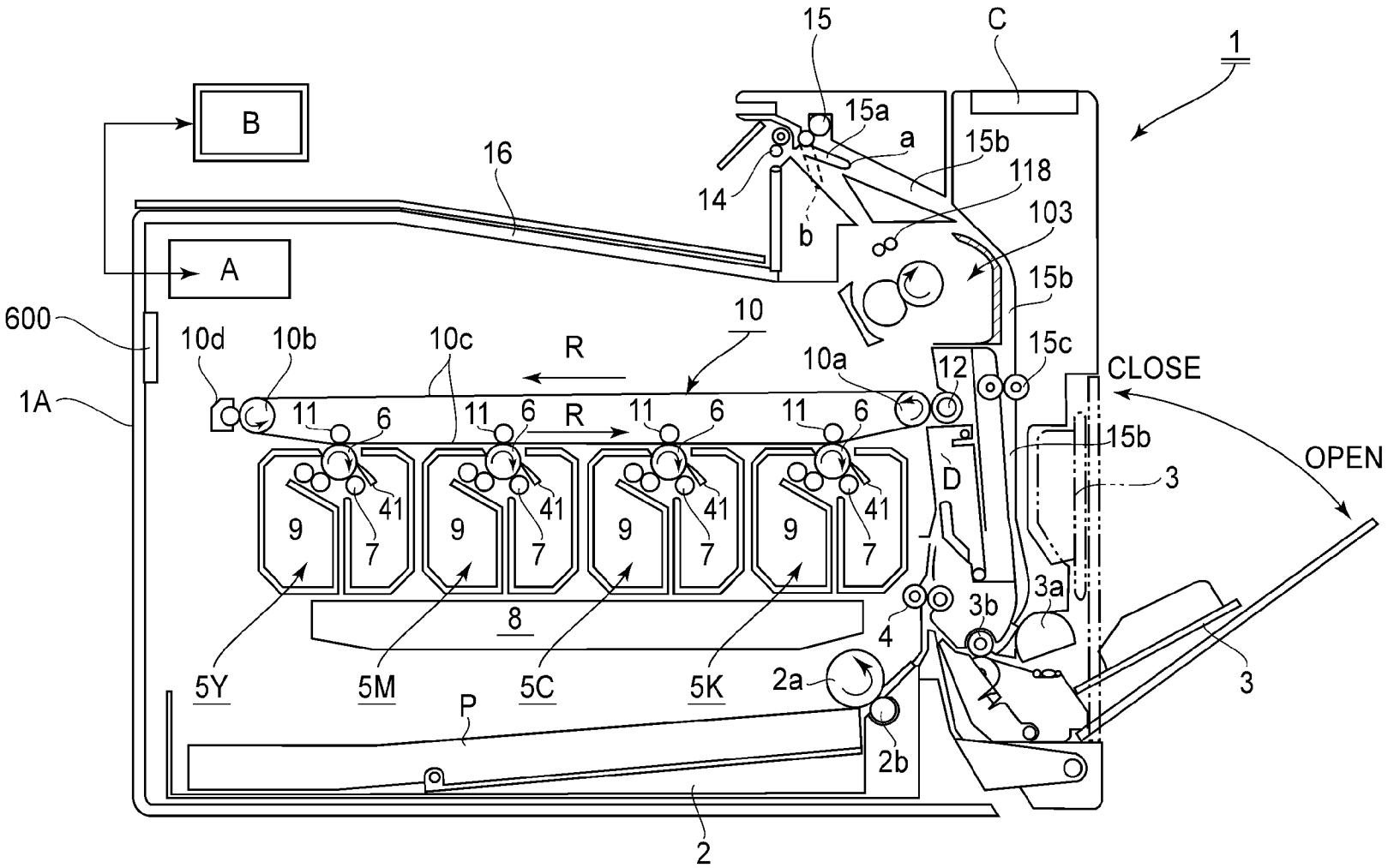
FIG. 3 is a schematic illustration of an image forming apparatus.

FIG. 3 is a schematic sectional view of an image forming apparatus 1. This image forming apparatus 1 is a four color-basis full-color laser beam printer (color image forming apparatus) using an electrophotographic process. That is, the image forming apparatus forms an image on a sheet P on the basis of an electric image signal inputted from an external host device B such as a personal computer or an image reader into a control circuit portion (control means or CPU) A. Examples of the sheet P may include a sheet, an OHP sheet, coated paper, label paper and the like.

The control circuit portion A transfers various pieces of electric information between itself and the external host device B or an operating portion C, and effects integrated control of an image forming operation of the image forming apparatus 1 in accordance with a predetermined control program and a reference table.

As an image forming portion, the image forming apparatus includes first to fourth (four) image forming stations (process cartridges) 5Y, 5M, 5C and 5K. The first to fourth image forming stations 5Y, 5M, 5C and 5K are successively arranged in parallel from a left side to a right side in FIG. 3 at a substantially central portion of an inside of the image forming apparatus 1.

Each image forming station includes the same electrophotographic process mechanism. Each of the image forming stations 5Y, 5M, 5C and 5K in this embodiment includes a rotation drum-type electrophotographic photosensitive member (hereinafter referred to as a "drum") 6 as an image bearing member on which an image is to be formed. As process means actable on the drum 6, a charging roller 7, a cleaning member 41 and a developing unit 9 are provided.

The first image forming station 5Y accommodates a yellow developer (toner) (Y) in a toner accommodating chamber of the developing unit 9. The second image forming station 5M accommodates a magenta toner (M) in a toner accommodating chamber of the developing unit 9. The third image forming station 5C accommodates a cyan toner (C) in a toner accommodating chamber of the developing unit 9. The fourth image forming station 5K accommodates a black toner (K) in a toner accommodating chamber of the developing unit 9.

In an apparatus main assembly IA, below the respective image forming stations 5Y, 5M, 5C and 5K, a laser scanner unit 8 as an image information exposure means for the respective drums 6 is provided. Further, in the apparatus main assembly 1A, on the respective image forming stations 5Y, 5M, 5C and 5K, an intermediary transfer belt unit 10 is provided.

The unit 10 includes a driving roller 10*a* provided on a right side in FIG. 3, a tension roller 10*b* provided on a left side in FIG. 3, and an intermediary transfer belt (hereinafter referred to as a belt) 10*c* as an intermediary transfer member extended and stretched between these rollers. Further, inside the belt 10*c*, first to fourth (four) primary transfer rollers 11 opposing the drums 6 of the respective image forming stations 5Y, 5M, 5C and 5K are provided in parallel to each other. An upper surface portion of each of the drums 6 of the image forming stations 5Y, 5M, 5C and 5K contacts a lower surface of the belt 10*c* in a position of the associated primary transfer roller 11. The contact portion is a primary transfer portion.

Outside a curved portion of the belt 10*c* contacting the driving roller 10*a*, a secondary transfer roller 12 is provided. A contact portion between the belt 10*c* and the secondary transfer roller 12 is a secondary transfer portion. Outside a curved portion of the belt 10*c* contacting the tension roller 10*b*, a transfer belt cleaning device 10*d* is provided.

At a lower portion of the apparatus main assembly 1A, a sheet feeding cassette 2 is provided. The cassette 2 is constituted so as to be pullable from and insertable into the apparatus main assembly 1A in a predetermined manner.

In FIG. 3, in a right side in the apparatus main assembly 1A, an upward sheet feeding path (vertical path) D is provided for feeding upward the sheet P picked up from the cassette 2. In the sheet feeding path D, in the order from a lower side to an upper side, a roller pair of a feeding roller 2*a* and a retard roller 2*b*, a registration roller pair 4, the secondary transfer roller 12, a fixing device (device) 103, a double-side flapper 15*a*, a discharging roller pair 14 are provided. An upper surface of the apparatus main assembly 1*a* constitutes a discharge tray (discharged sheet stacking portion) 16.

In FIG. 3, in a right surface side of the apparatus main assembly 1A, a manual feeding portion (multi-purpose tray) 3 is provided. The manual feeding portion 3 is capable of being placed in a closed state (retracted state) in which the manual feeding portion 3 is vertically raised and folded with respect to the apparatus main assembly 1A as indicated by a chain double-dashed line during non-use. During use, the manual feeding portion 3 is turned on its side as indicated by a solid line to be placed in an open state.

(1-1) Image Forming Sequence of Image Forming Apparatus

An operation for forming a full-color image is as follows.

A control circuit portion A starts an image forming operation of the image forming apparatus 1 on the basis of a print start signal. That is, in synchronism with the image formation timing, each of the drums 6 of the first to fourth image forming stations 5Y, 5M, 5C and 5K is rotationally driven at a predetermined speed in the clockwise direction indicated by an arrow. Also the belt 10*c* is rotationally driven at a speed corresponding to the speed of the drum 6 in the counterclockwise direction (the same direction as the rotational direction of the drum 6) indicated by an arrow R. Also the laser scanner unit 8 is driven.

In synchronism with this drive, at each of the image forming stations 5Y, 5M, 5C and 5K, a surface of the drum 6 is electrically charged uniformly to a predetermined polarity and a predetermined potential by the charging roller 7 to which a predetermined charging bias is applied. The surface of each drum 6 is subjected to scanning exposure, by the laser scanner unit 8, to a laser beam modulated depending on an image information signal of an associated one of colors of Y, M, C and K. As a result, an electrostatic latent image, depending on the image information signal of the associated color, is formed on the surface of each drum 6. The formed electrostatic latent image is developed as a toner image (developer image) by a developing roller (developing member) of the developing unit 9. To the developing roller, a predetermined developing bias is applied.

By the electrophotographic image-forming-process operation as described, above, a Y color toner image corresponding to a Y component of the full-color image is formed on the drum 6 of the first image forming station 5Y. The toner image is primary-transferred onto the belt 10*c* at the primary transfer portion of the image forming station 5Y. An M color toner image corresponding to an M component of the full-color image is formed on the drum 6 of the second image forming station 5M. The toner image is primary-transferred superposedly onto the toner image of Y which has already been transferred on the belt 10*c* at the primary transfer portion of the image forming station 5M. A C toner image corresponding to a C component of the full color image is formed on the drum 6 of the third image forming station 5C. The toner image is primary-transferred superposedly onto the toner images of Y and M which have already been transferred on the belt 10*c* at the primary transfer portion of the image forming station 5C. A K color toner image corresponding to a K component of the full-color image is formed on the drum 6 of the fourth image forming station 5K. The toner image is primary-transferred superposedly onto the toner images of Y, M and C which have already been transferred on the belt 10*c* at the primary transfer portion of the image forming station 5K.

To each of the first to fourth primary transfer roller 11, at a predetermined control timing, a primary transfer bias of an opposite polarity to a charge polarity of the toner and of a predetermined potential is applied. In this way, unfixed full-color toner images of Y, M, C and K are synthetically formed on the moving belt 10*c*. These unfixed toner images are conveyed by subsequent rotation of the belt 10*c* to reach the secondary transfer portion.

At each of the image forming stations 5, the surface of the drum 6 after the primary transfer of the toner image onto the belt 10*c* is wiped with a cleaning member (cleaning blade) 41 to remove a primary transfer residual toner, thus being subjected to a subsequent image forming step.

On the other hand, the sheets P in the cassette 2 are fed one by one by the feeding roller 2*a* and the retard roller 2*b* at a predetermined control timing, and the fed sheet P is fed to the registration roller pair 4. In the case of an operation in a manual feeding mode, the sheet P on the manual feeding tray 3 is fed by a feeding roller 3*a* and then is fed to the registration roller pair 4 by a feeding roller pair 3*b*.

The sheet P is fed to the secondary transfer portion at a predetermined control timing by the registration roller pair 4. To the secondary transfer roller 12, at a predetermined control timing, a secondary transfer bias of an opposite polarity to a normal charge polarity of the toner is applied. As a result, in a process in which the sheet P is nipped and fed through the secondary transfer portion, the superposed four color toner images on the belt 10*c* are collectively secondary-transferred onto the surface of the sheet P.

The sheet P coming out of the secondary transfer portion is separated from the belt 10*c* to be fed into the fixing device 103, and then the toner images are thermally fixed on the sheet P. The sheet P coming out of the fixing device 103 passes through, via a sheet discharging roller pair 118, a lower side of the double-side flapper 15*a* held in a first attitude a indicated by a solid line, and then is discharged onto the discharge tray 16 by the discharging roller pair 14. A secondary transfer residual toner remaining on the surface of the belt 10*c* after the secondary transfer of the toner images onto the sheet P is removed from the belt surface by the transfer belt cleaning device 10*d*, and then the cleaned belt surface is subjected to a subsequent image forming step.

The sheet P, coming out of the fixing device 103, which has already been subjected to image formation at its one (first) surface (side), is not discharged onto the discharge tray 16, but can also be subjected to double-side printing by being fed into a re-circulating feeding path 15*b* for effecting printing on another (second) surface (side) of the sheet P. In this case, the sheet P, coming out of the fixing device 103, which has already been subjected to image formation at its one surface passes through an upper side of the double-side flapper 15*a* switched to a second attitude b indicated by a broken line, and then is fed toward the discharge tray 16 by a switch-back roller 15.

Then, when a downstream end of the sheet P with respect to a feeding direction reaches a position on the double-side flapper 15*a*, the double-side flapper 15*a* is returned to the first attitude a, and at the same time, the switch-back roller 15 is reversely driven. As a result, the sheet P is reversely fed downward in the re-circulating path 15*b* to the registration roller pair 4 again via a feeding roller pairs 15*c* and 3*b*. Thereafter, similarly as in the case of an operation in a one-side image forming mode, the sheet P, which has already subjected to the double-side printing, is fed through a path including the secondary transfer portion, the fixing device 103, the discharging roller pair 14, thus being discharged onto the discharge tray 16.

Incidentally, in this embodiment, as the image forming apparatus 1, the full-color laser beam printer including the plurality of drums 6 is used, but the present invention is applicable to also a fixing device to be mounted into a monochromatic copying machine or printer. Therefore, the image forming apparatus in which the fixing device of the present invention is to be mounted is not limited to the full-color laser beam printer.

(2) Structure of Fixing Device 103

Figure 1:
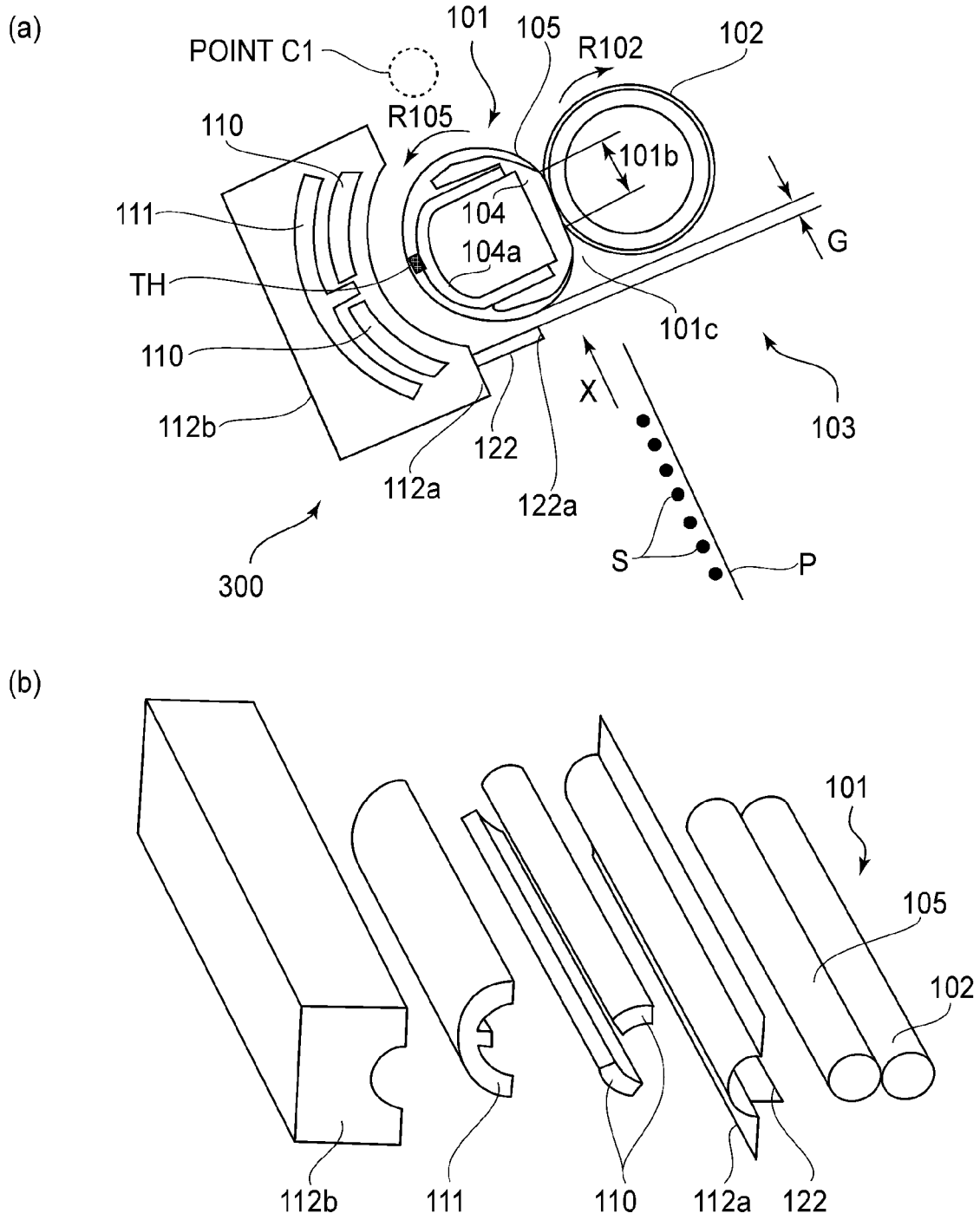
In FIG. 1, (a) and (b) are a schematic sectional view and an exploded perspective view, respectively, of a fixing device.

Next, the fixing device 103 will be described. In FIG. 1, (a) is a schematic sectional view of the fixing device 103, and (b) is an exploded perspective view of the fixing device 103. The fixing device in this embodiment is constituted by a fixing belt unit 101 including a fixing belt 105, a pressing roller 102, is a second rotatable member, and a heating portion 300 for heating, through electromagnetic induction heating, the fixing belt 105, which is a first rotatable member. The fixing device 103 is an elongated apparatus, elongated in a direction perpendicular to the feeding direction (sheet feeding direction) X of the sheet P in a plane of a sheet feeding path at a nip 101*b* between the fixing belt 105 and the pressing roller 102.

The sheet P is nipped and fed through the nip 101*b* between the pressing roller 102 and the fixing belt 105 and heated in a non-contact manner by the heating portion 300. The unfixed toner image formed on the sheet S contacts the fixing belt 105 at the nip 101*b*, so that the toner image is heated and melted and is further press-contacted to the fixing belt 105, and thus is fixed on the sheet S.

(2-1) Structure of Fixing Belt Unit 101

Figure 2:
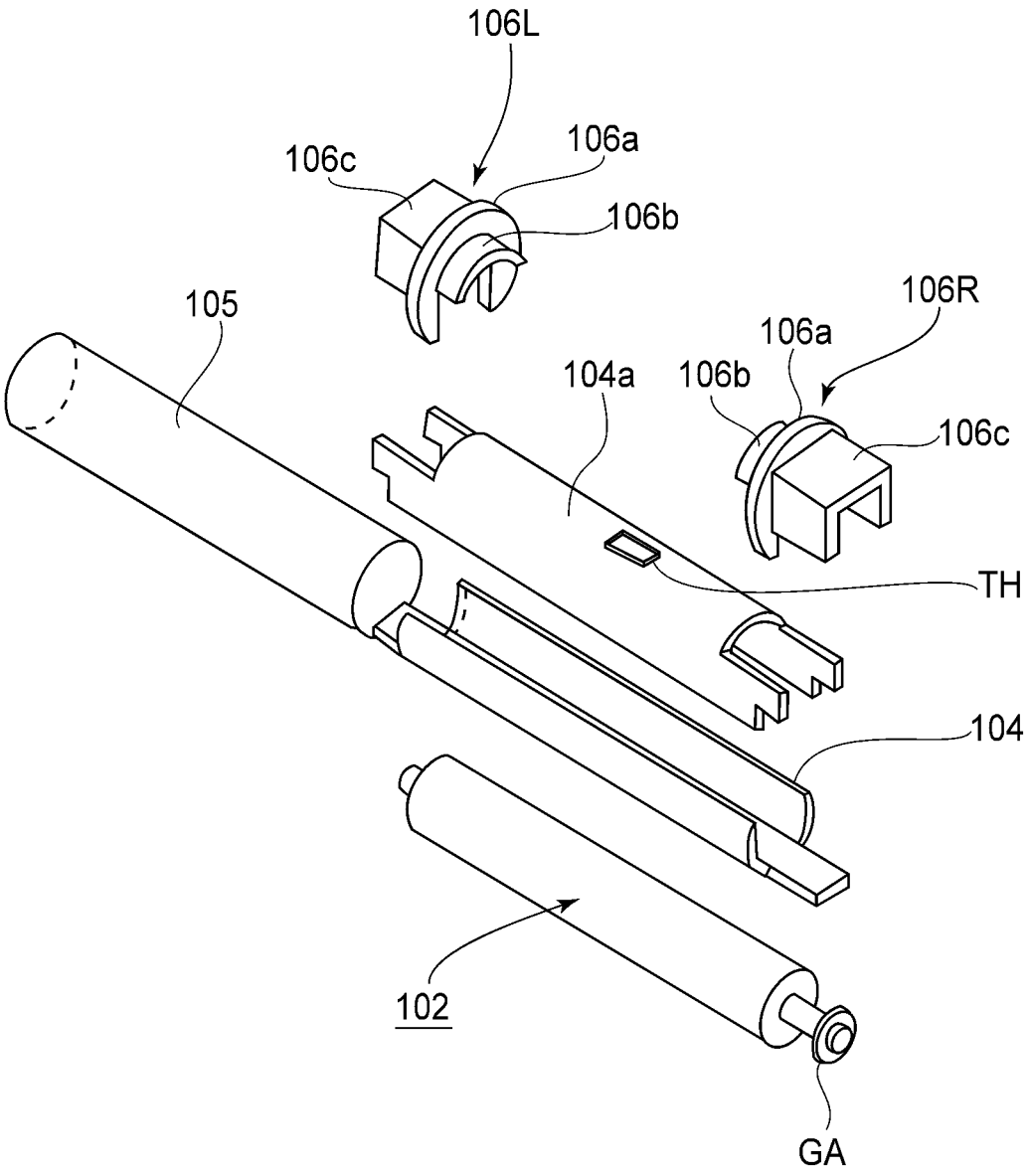
FIG. 2 is an exploded perspective view of a fixing unit.

FIG. 2 is an exploded perspective view of the fixing belt unit 101. Incidentally, also the pressing roller 102 is illustrated in FIG. 2.

The fixing belt unit 101 is an assembled member including a pressure applying member 104, an urging (pressing) stay 104*a*, the fixing belt 105 as a rotatable heating member (endless belt) to be rotated, flanges 106L and 106R positioned at end sides of the fixing belt 105 with respect to the widthwise direction of the fixing belt 105, and the like.

The pressure applying member 104 is an elongated member having an almost semi-circular trough shape in cross section, and is formed of a heat-resistant resin material such as a liquid crystal polymer. The urging stay 104*a* is an elongated rigid member having a U-shape in cross section, and is formed of metal such as iron and is provided inside the pressure applying member 104. The fixing belt 105 is loosely engaged (fitted) externally with the assembled member of the pressure applying member 104 and the urging stay 104*a*.

The flanges 106L and 106R are symmetrical molded members formed of a heat-resistant resin material, and are mounted symmetrically in longitudinal end sides of the pressure applying member 104. The flanges 106L and 106R hold the fixing belt 105 and guide rotation of the fixing belt 105. Movement of widthwise end portions of the fixing belt 105 in a widthwise direction is limited by the flanges 106L and 106R.

Each of the flanges 106L and 106R includes, as shown in FIG. 2, a flange portion 106*a*, a shelf portion 106*b* and a portion-to-be-urged 106*c*. The flange portion 106*a* is a member for limiting movement of the fixing belt 105 in a thrust direction by receiving an end surface of the fixing belt 105, and has an outer configuration larger than the outer configuration of the fixing belt 105. The shelf portion 106*b* is provided in an arcuate shape on the flange portion 106*a* and holds the fixing belt end portion inner surface to keep the cylindrical shape of the fixing belt 105. The portion-to-be-urged 106*c* is provided at an outer surface side of the flange portion 106*a*, and an urging force is applied thereto by springs 108L and 108R shown in FIG. 5, so that the portion-to-be-urged 106*c* performs the function of causing the fixing belt 105 to be press contacted to the pressing roller by the urging force applied via the pressure applying member 104.

(2-1-1) Structure of Fixing Belt

Figure 4:
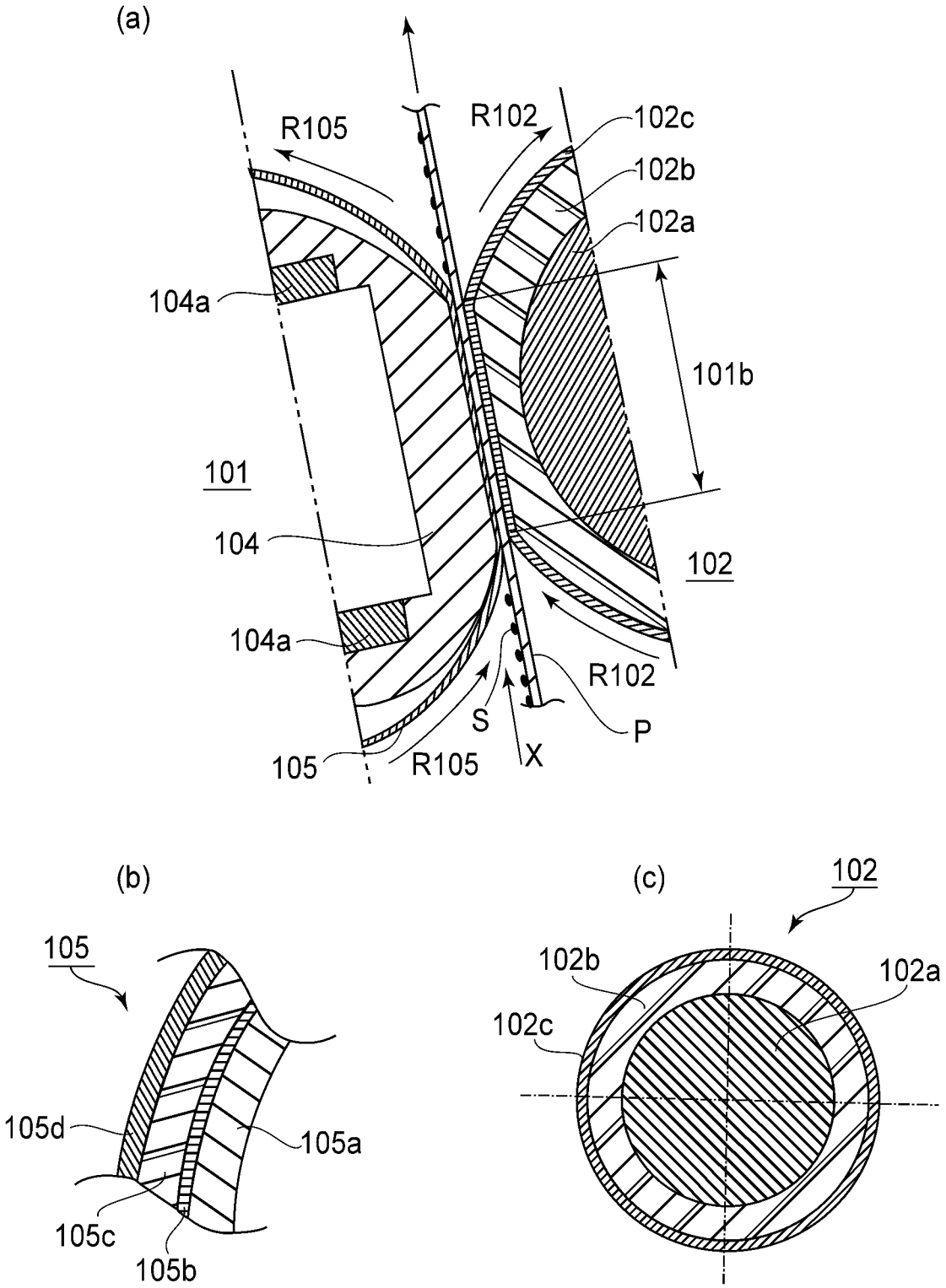
In FIG. 4, (a) is an enlarged view of a nip in (a) of FIG. 1, (b) is a schematic view showing a layer structure of a fixing belt, and (c) is a schematic view showing a layer structure of a pressing roller.

In FIG. 4, (a) is a partly enlarged view of the nip 101*b* shown in (a) of FIG. 1, and (b) is a schematic view showing a layer structure of the fixing belt 105 in this embodiment. The fixing belt 105 is a thin member having a flexibility as a whole and a low heat capacity. The fixing belt 105 is a composite-layer member in which an endless (cylindrical) base layer 105*a*, a primer layer 105*b*, an elastic layer 105*c* and a parting layer 105*d* are laminated in the listed order from an inside to an outside thereof.

The base layer is formed of nickel in an inner diameter of 30 mm and a thickness of 40 μm by electroforming. The elastic layer 105*c* formed of a heat-resistant silicone rubber, and is bonded toward the base layer 105*a* via the primer layer 105*b*. The elastic layer 105*c* is deformed when the toner image is press-contacted to the fixing belt 105, and thus performs the function of causing the parting layer 105*d* to be hermetically contacted to the toner image. The thickness of the elastic layer 105*c* may preferably be set in a range of 100-1000 μm. In this embodiment, in view of shortening of the warm-up time by decreasing the heat capacity of the fixing belt 105 and obtaining of a fixing image suitable when a color image is fixed, the thickness of the elastic layer is set at 300 μm. The silicone rubber has a hardness of 20 degrees as JIS-A hardness and the thermal conductivity of 0.8 W/mK.

On the outer peripheral surface of the elastic layer 105*c*, a fluorine-containing resin layer (of, e.g., PFA or PTFE) as the surface parting layer l*c* is provided in a thickness of 30 μm. As a material for the parting layer 105*d*, a fluorine-containing resin having an excellent parting property and heat-resistant property is used for preventing deposition of the toner and paper power (dust).

(2-2) Structure of Heating Portion 300

In this embodiment, the heating portion 300 is disposed opposed to the outer surface of the fixing belt 105, which is a first rotatable member, and is a heating means for heating the fixing belt 105 in the non-contact manner through electromagnetic induction heating. Specifically, the heating portion 300 is a device for induction-heating the base layer 105*a* of the fixing belt 105. In this embodiment, the heating portion 300 includes an exciting coil 110 and an outside magnetic core 111.

The exciting coil 110 is provided so as to oppose a part of the peripheral surface of the fixing belt 105 by winding the Litz wire in an elongated trough-like shape. A magnetic field generated by the exciting coil passes through the outside magnetic core 111 covering the exciting coil 110 and the base layer 105*a* of the fixing belt 105, and therefore does not leak out. The outside magnetic core 111 covering the exciting coil 110 is supported by an inside casing 112*a* and an outside casing 112*b*, which are formed of an electrically insulating resin material. The inside casing 112*a* is provided opposed to the outer peripheral surface of the belt 105 via a predetermined gap (spacing).

In this embodiment, the inside casing 112*a* and the outside casing 112*b* constitute a holding portion for holding the coil 110 and the core 111, which constitute the heating portion 300. In a rotation state of the fixing belt 105, to the exciting coil 110, a high frequency current of 20 kHz - 50 kHz is applied from an unshown power source (exciting circuit). The magnetic field generated from the coil 110 induction heats the base layer 105*a* of the fixing belt 105.

(2-3) Structure of Pressing Roller

In FIG. 4, (c) is a schematic view showing a layer structure of the pressing roller 102.

The pressing roller 102 is an elastic roller including a metal core 102*a* of aluminum or iron, an elastic layer 102*b* formed of a silicone rubber or the like, and a parting layer 102*c* for coating the elastic layer 102*b*. The parting layer 102*c* is formed of a fluorine-containing resin material, such as PFA, and is coated with a tube.

Figure 5:
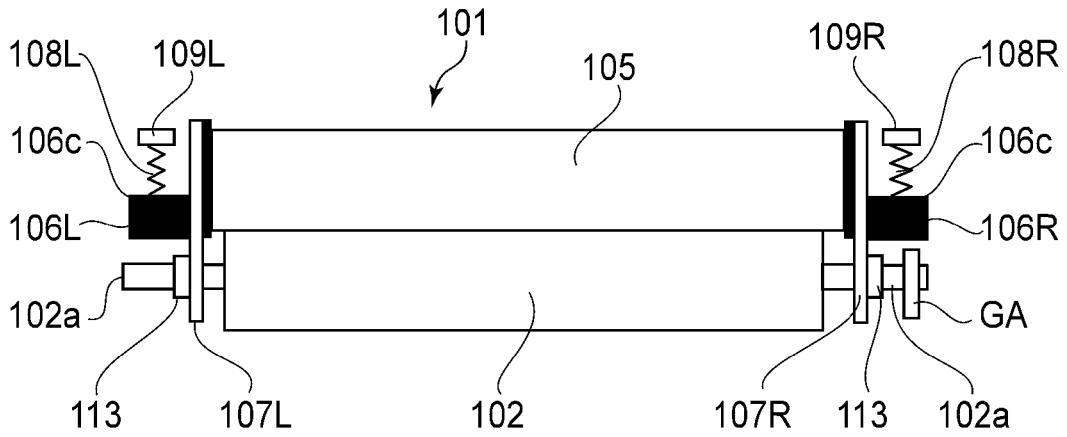
FIG. 5 is an illustration of a pressing mechanism for a fixing belt unit.

As shown in FIG. 5, the metal core 102*a* of the pressing roller 102 is rotatably supported between a side plate 107L and another side plate 107R via bearings 113. On the other hand, the fixing belt unit 101 is disposed parallel to the pressing roller 102 between the side plate 107L and another side plate 107R.

The flanges 106L and 106R in the end sides of the fixing belt unit 101 are urged toward the pressing roller 102 with a predetermined urging force T by the springs 108L and 108R. The springs 108L and 108R are supported by supporting portions 109L and 109R provided in the image forming apparatus.

As a result, the fixing belt 105 is rotated by rotation of the pressing roller 102 rotationally driven by an unshown driving source. That is, in this embodiment, the pressing roller 102 performs also the function of a driving roller (rotatable driving member) for rotationally driving the fixing belt 105.

By the above-described urging force, a whole assembly comprising the flanges 106L and 106R, the urging stay 104*a*, and the pressure applying member 104 is urged toward the pressing roller 102. As a result, the nip 101*b* ((a) of FIG. 1 and (a) of FIG. 4) having a predetermined width is formed between the fixing belt 105 and the pressing roller 102.

(2-4) Fixing Sequence

The operation of a fixing sequence (fixing process) of the fixing device 103 is as follows.

The control circuit portion A rotationally drives the pressing roller 102 at a predetermined control timing in a rotational direction R102 in (a) of FIG. 1 at a predetermined speed. The rotational driving of the pressing roller 102 is made by transmitting a driving force of a driving source (not shown) to a driving gear GA (FIGS. 2 and 5) provided integrally with the pressing roller 102.

By the rotational driving of the pressing roller 102, at the nip 101*b*, a rotational torque acts on the fixing belt 105 due to a frictional force between the fixing belt 105 and the pressing roller 102. As a result, the fixing belt 105 is rotated around the pressure applying member 104 and the urging stay 104*a* by the pressing roller 102 at a speed substantially corresponding to the speed of the pressing roller 102, sliding at its inner surface on the pressure applying member 104 in close contact with the pressure applying member.

Further, the control circuit portion A starts electric energy (power) supply from a power source portion (not shown) to the exciting coil 110. By this electric energy supply, the exciting coil 110 generates the magnetic field in a part 114 (FIG. 6) of a region of the fixing belt 105, and heats the fixing belt 105. The part 114 constitutes a heating region of the fixing belt 105. The temperature rise by the heating is detected by a thermistor TH as a temperature detecting means provided on the urging stay 104*a*.

The control circuit portion A controls, on the basis of the back surface temperature of the fixing belt 105 detected by the thermistor TH, electric power to be supplied to the exciting coil 110 so that the fixing belt (back surface) temperature is increased up to and kept at a predetermined target set temperature. The target set temperature in this embodiment is about 170° C.

In the state of the fixing device described above, the sheet P on which unfixed toner images S are carried is fed from the secondary transfer portion side of the image forming portion to the fixing device 103 side. Then, the sheet P is introduced into a nip entrance 101*c* ((a) of FIG. 1), so that the sheet P is nipped and fed through the nip 101*b*. To the sheet P, heat is applied via the fixing belt 105 heated in a process in which the sheet P is nipped and fed through the nip 101*b*. The unfixed toner images S are melted by the heat of the fixing belt 105 and are fixed on the sheet P by pressure applied to the nip 101*b*. The sheet P coming out of the nip 101*b* is sent to the outside of the fixing device 103 by a fixing discharge roller pair 118 (FIG. 3).

(3) Parting Agent Incorporated in Toner

Next, a parting agent incorporated (contained) in the toner S, i.e., a wax in this embodiment will be described.

There is a risk of causing the occurrence of a phenomenon called offset, in which the toner S is transferred onto the fixing belt 105 during fixing. Such an offset phenomenon leads to a condition which causes a problem such as an image defect.

Therefore, in this embodiment, the wax is incorporated into the toner S. That is, during the fixing, the wax bleeds from the toner S. As a result, the wax melted by heating is present at an interface between the fixing belt 105 and the toner image on the sheet P, so that it becomes possible to prevent the offset phenomenon (parting action).

Incidentally, also a compound containing a molecular structure of the wax is referred herein to as the wax. For example, such a wax is obtained by reacting a resin molecule of the toner with a wax molecular structure. Further, as a parting agent, other than the wax, it is also possible to use another substance, such as a silicone oil, having a parting action.

In this embodiment, paraffin wax is used and the melting point Tm of the wax is about 75° C. In the case where the heater temperature at the nip 101*b* is kept at the target set temperature of 170° C., the melting point Tm is set so that the wax in the toner S is instantaneously melted to bleed out to an interface between the toner image and the fixing belt 105.

The wax bleeding out from the toner image is positioned at the interface between the toner image and the fixing belt 105, but a part thereof is heated on the fixing belt 105 after being transferred the fixing belt 105. This is because the surface of the fixing belt 105 from which heat is taken by the sheet P at the nip 101*b* and which is lowered in temperature is heated again by the heating portion (induction heating device) 300.

Further, a part of the wax such as a low-molecular-weight component in the wax is vaporized (volatilized). Although the wax is constituted by a long-chain molecular component, a length of the component is not uniform and has a certain distribution. The wax contains a low-molecular-weight component having a short chain and a low boiling point and a high-molecular-weight component having a long chain and a high boiling point. When the wax is vaporized in the heating region 114, it would be considered that the low-molecular-weight component as a part of the wax is vaporized.

The vaporized wax component is condensed by being cooled in the air, so that fine particles (dust) of several nm to several hundred nm in particle diameter can exist immediately after the condensation. However, most of the condensed wax component forms the fine particles of several nm to several ten nm in particle diameter.

This can be confirmed by measuring the dust.

In the direction, measurement of the dust was made using a high-speed response type particle sizer ("FMPS", mfd. by TSI Inc.) was used. The particle sheet (FMPS) is capable of measuring a particle size distribution, a number density (concentration) (particles/$cm^3$) and a weight density (concentration) ($\mu g/m^3$). In the present invention, the fine particles of 5.6 nm or more and 560 nm or less in particle size measurable by the particle sizer (FMPS) are regarded as the dust.

Figure 7:
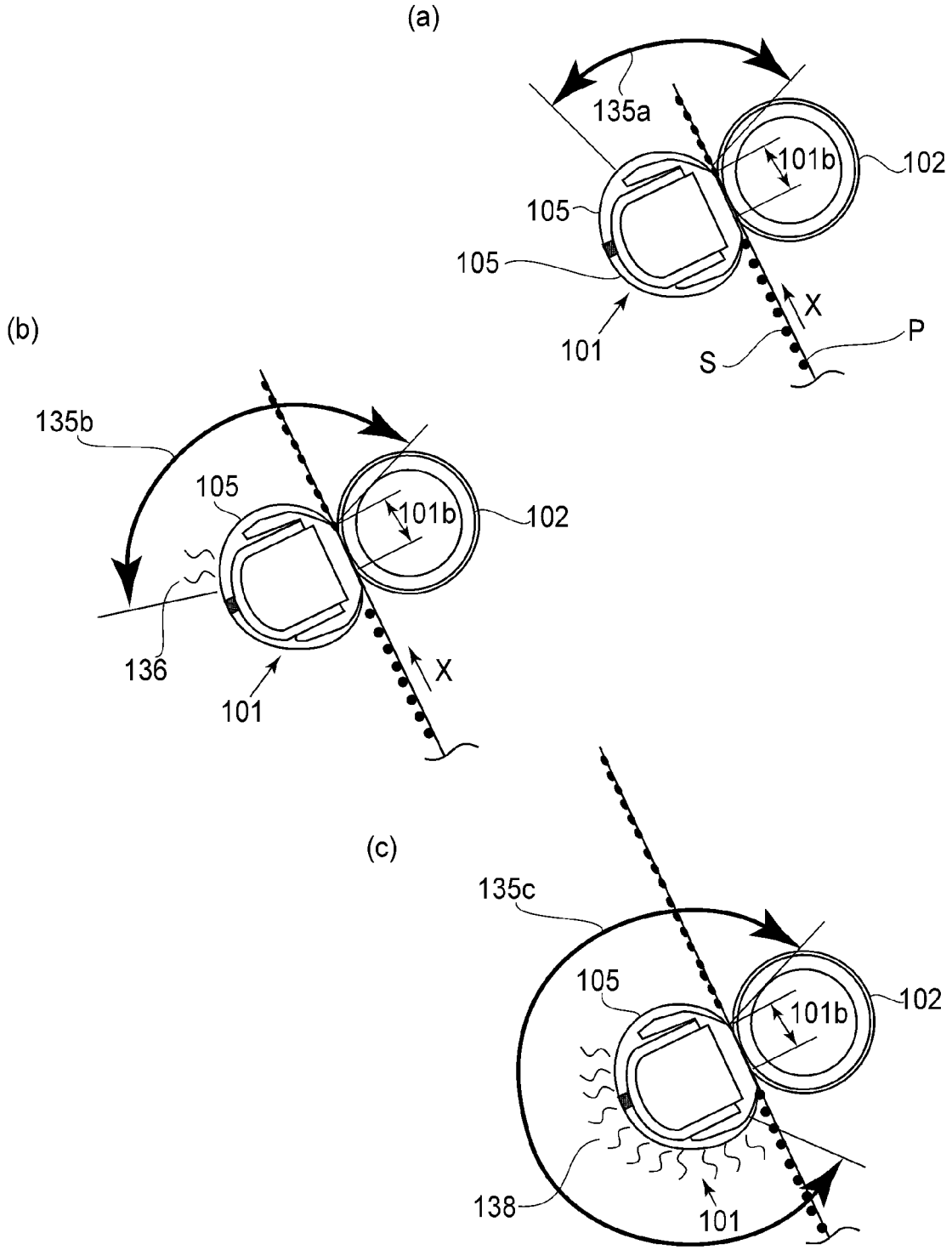
In FIG. 7, (a) to (c) are illustrations showing a wax deposition region and a dust generating region on the fixing belt.
Figure 8:
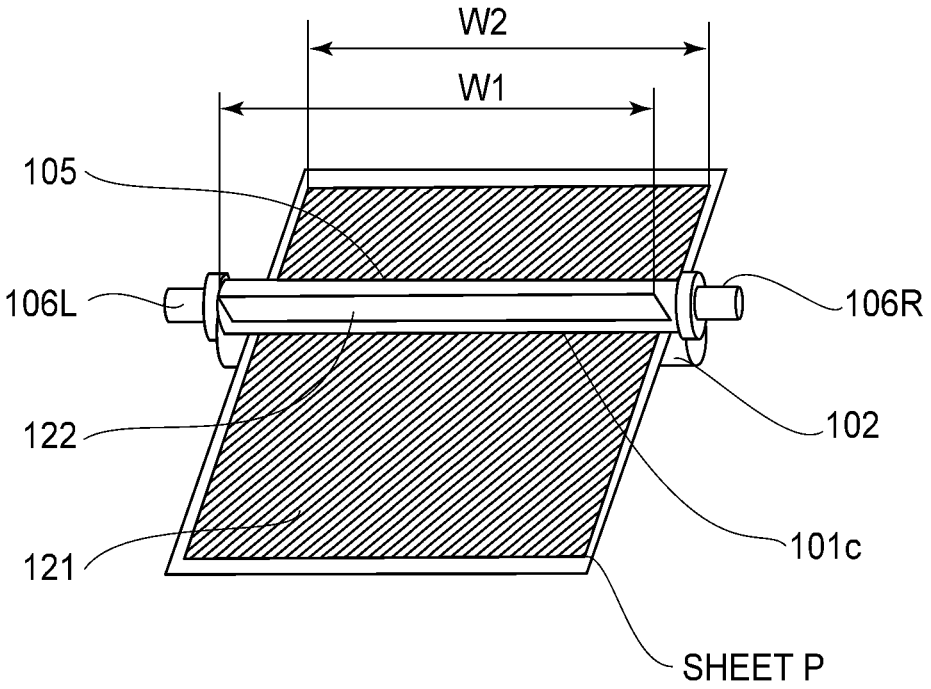
FIG. 8 is an illustration showing a rib disposing region as a suppressing portion.

(4) Generated Particles (Dust) Resulting from Parting Agent with Fixing Process (4-1) Dust Generation Position In FIG. 7, each of (a) to (c) shows a process in which the wax deposited on the fixing belt 105 is vaporized. In FIG. 7, the heating portion 300 is omitted from illustration. In a state of (a) of FIG. 7, only a leading end portion of the toner images passes through the nip 101*b*, and therefore a wax deposition region in a range 135*a* shown in the figure. In this stage, the wax is not vaporized.

Figure 6:
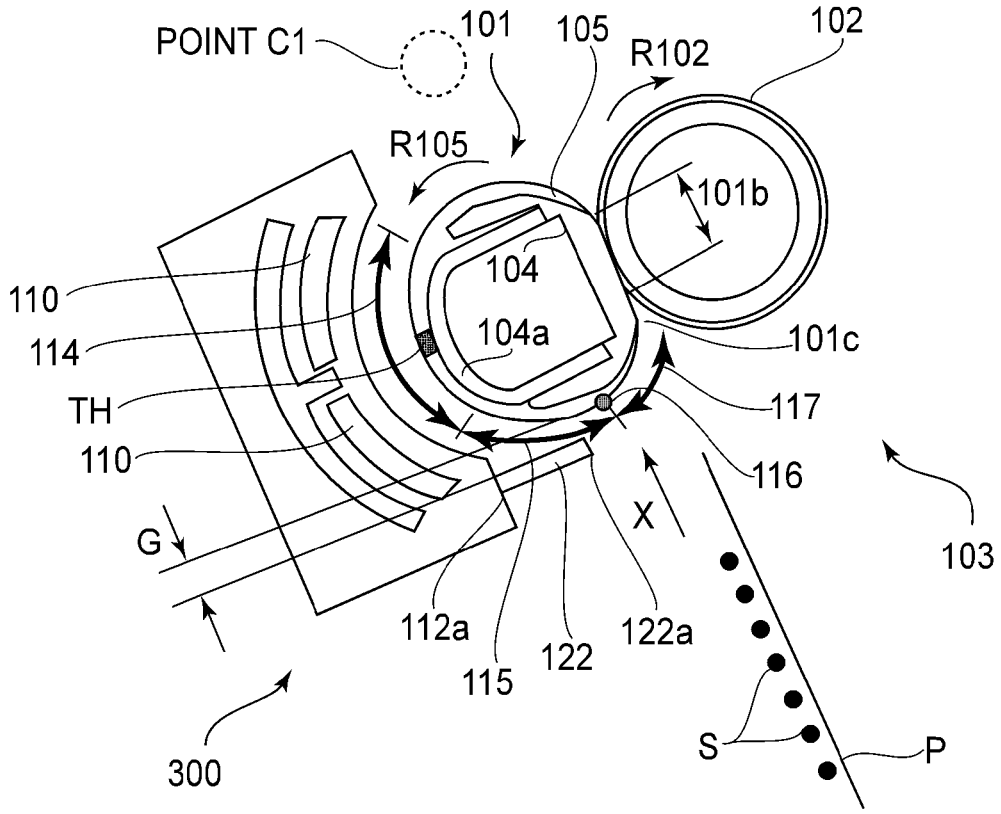
FIG. 6 is an illustration showing a heating region of the fixing belt.

In a state of (b) of FIG. 7, the wax deposition region extends to a range 135*b* in the figure and partly overlaps with the heating region 114 shown in FIG. 6. At an overlapping portion 136, the dust is generated simultaneously with start of the vaporization of the wax. In a state of (c) of FIG. 7, the wax deposition region extends to a range 135*c*, so that the wax is vaporized in a broader range 138, thus the dust is generated.

This dust is the wax component and therefore has an adhesive property, so that there is a risk that the dust is deposited in positions inside the image forming apparatus 1 to cause a problem. For example, when the dust is fixed and deposited on the fixing discharge roller pair 118 (FIG. 3) and the discharge roller pair 114 to generate contamination, there is a risk that the contamination is transferred onto the sheet P to adversely affect the image. Further, there is a risk that the dust is deposited on a filter 600 (FIG. 3) provided in an exhausting (heat exhausting) mechanism for exhausting ambient air at a periphery of the fixing device 103, thus causing clogging.

(4-2) Property of Dust

According to study by the present inventor, it has turned out that the particle size of the dust generated from the fixing belt 105 depends on a spatial temperature in the neighborhood of the fixing belt 105.

Figure 9:
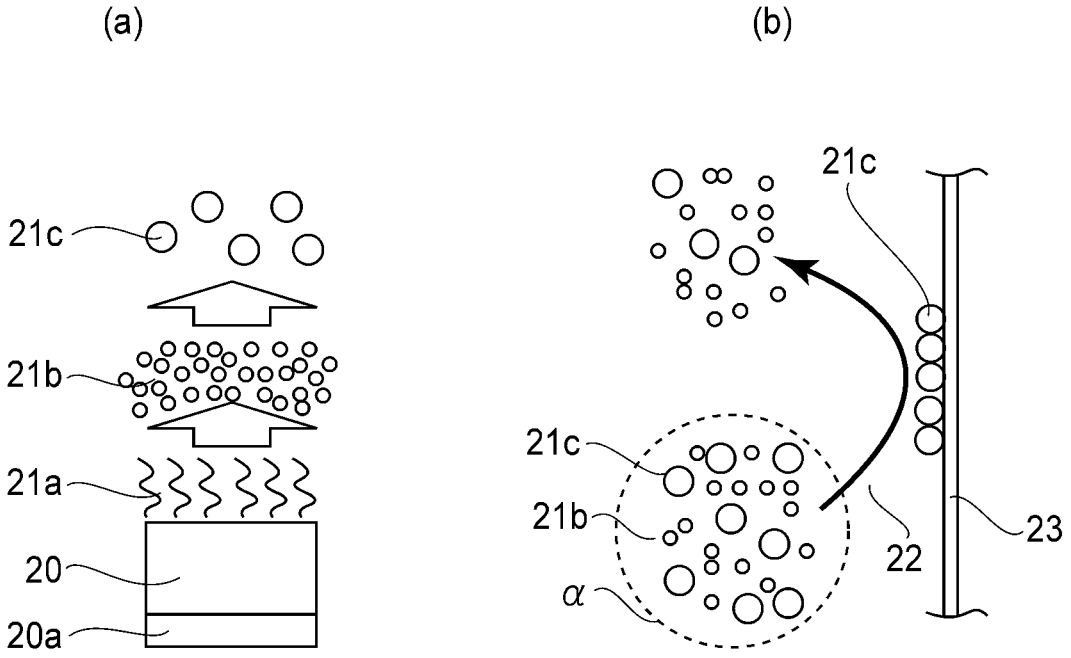
In FIG. 9, (a) is a schematic view showing a coalescence phenomenon of a dust, and (b) is a schematic view for illustrating a deposition phenomenon of the dust.

As shown in (a) of FIG. 9, when a high-boiling-point substance 20 of 150-200° C. in boiling state is placed on a heating source 20*a* and is heated to about 200° C., a volatile matter 21*a* of the high-boiling-point substance 20 is generated. The volatile matter 21*a* is decreased in temperature to a boiling point temperature or less immediately after the volatile matter 21*a* contacts the air at a normal temperature, and therefore the volatile matter 21*a* agglomerates in the air, thus being changed into fine particles (dust) 21*b* of several nm to several ten nm in particle size. This phenomenon is the same as a phenomenon that water vapor is changed into minute water droplets to generate fog when the temperature of the water vapor is below a dew-point temperature.

In this case, the impairing of the agglomeration and particle formation of the gas in the air increases with an increase in the temperature in the air. This is because vapor pressure increases as the temperature in the air increases, and thus gas molecules are easily kept in a gaseous state. As a result, with the higher temperature in the air, the number of particles of the dust generated becomes smaller.

Further, excessive gas existing in the air gathers around the dust and thus agglomerates on the dust. This is because compared with energy required for newly generating the dust by agglomeration of the gas molecules, the energy required for causing the gas molecules to agglomerate around the dust is lower.

It has been known that the particles of dust 21*b* generated in the above-described process move in the air by the Brownian movement and therefore mutually collide and coalesce to grow into the particles of the dust 21*c* having a larger particle size. This growth is accelerated when the dust more actively moves, in other words, when the temperature in the air is in a higher temperature state. As a result, with respect to the particle size of the dust and the number of particles of the dust, with a higher spatial temperature in the neighborhood of the fixing belt 105, the particle size becomes larger and the number of particles becomes smaller.

Further, the growth of the particle size gradually slows down and stops when the dust has a certain particle size or more. This is presumably because when the dust is increased in particle size by the coalescence, the movement of the dust in the air by the Brownian movement becomes inactive.

Further, as a property of the dust resulting from the parting agent (wax), such a property that the dust deposits on an ambient solid matter has been known. With reference to (b) of FIG. 9, the case where the air a containing the minute dust 21*b* and the larger dust 21*c* moves toward a wall 23 along airflow 22 will be considered. At this time, the larger dust 21*c* larger than the minute dust 21*b* is liable to be deposited on the wall 23 and is less liable to be diffused.

This is presumably because the dust 21*c* has a large force of inertia and vigorously collides against the wall 23. This phenomenon is similarly generated even in the case where the airflow speed is not more than 0.2 m/s, which is below the measurement limit of an anemometer, i.e., even in the case where the airflow speed is very slow. Therefore, it is understood that when the dust 21*c* is increased in particle size more and more, particularly, the fine particles of about several hundred nm are readily left in the fixing device (most of the fine particles are deposited on the belt), and thus diffusion toward the outside of the fixing device can be suppressed.

In this way, the dust has two properties including such a property that the dust is increased in particle size with the increase in the temperature in the air and such a property that the dust is liable to be deposited on a peripheral object (member) when the dust is increased in particle size. Accordingly, it is understood that when the dust is increased in particle size by increasing the temperature in the air, it is possible to suppress the diffusion of the dust toward the outside of the fixing device in a state of the fine particles (particle size immediately after the condensation). Incidentally, the ease of the coalescence of the dust depends on the temperature and density of the dust. For example, when an easily adhesive component is softened at high temperatures and when the collision probability between dust particles is increased at a high density, the dust particles are liable to coalesce.

(5) Dust Diffusion Suppressing Mechanism

When a dust diffusion suppressing measure in the image forming apparatus 1 is studied on the basis of the above-described properties of the dust, it is understood that the temperature in the air in the neighborhood of the dust generating position (portion) 138 indicated by wavy lines in (c) of FIG. 7 may only be required to be increased. When the dust generating position is described on the basis of FIG. 6, the dust generating position is a region obtained by adding, to the heating region 114 on the fixing belt 105, a region ranging from the heating region 114 to the nip entrance 101*c* along the rotational direction R105 of the fixing belt 105.

In this embodiment, as the above-described diffusion suppressing mechanism, a rib 122 as an extended portion (suppressing portion) has an end portion 122*a* disposed at a position of 0.5 mm or more and 3.5 mm or less from the surface of the fixing belt 105 is provided. The rib 122 suppresses airflow in a space between the fixing belt 105 and the inside causing 121*a*, and thereby suppresses diffusion, from the surface of the fixing belt 105, of the particles which result from the parting agent and which have a predetermined particle size.

Specifically, the rib 122 shown in FIG. 6 is such an extended portion that the rib 122 is extended from the inside casing 112*a*, which is holding portion for holding the heating portion for holding the heating portion 300, to the neighborhood of the fixing belt 105 while approaching the fixing belt 105. The rib 122 is integrally molded with the inside casing 112*a*. That is, the rib 122 as the extended portion is integrally molded with the holding portion for holding the heating portion 300.

The end portion 122*a* of the rib 122 as the extended portion is extended to the neighborhood of a terminal position 116 of a region 117 where the leading end of the sheet P is contactable to the fixing belt 105. The region 117 means the region where the leading end of the sheet P is contactable to the fixing belt 105 when the leading end of the sheet P is curled or bent (folded). Further, a width W1 of the rib 122 with respect to the longitudinal direction is, as shown in Figure which is a perspective view of a principal part of the fixing device (from which the induction heating device 300 is omitted), set so as to be wider than a width W2 of the sheet P in a passing region of a toner image 121.

When the maximum-width sheet usable in the image forming apparatus is used, the width W2 corresponds to a width (maximum image width) in which the image is formable on the maximum-width sheet. As a result, the rib 122 has such a positional relationship with the sheet P that the rib 122 is extended to positions outside the region where the fixing belt 105 is contactable to the toner image 121. This is because the dust is generated in the toner image passing region of the fixing belt.

That is, the end portion 122*a* of the rib 122 is disposed in the position 116, where the leading end of the sheet P introduced into the nip 101*b* and the fixing belt 105 are contactable to each other, and the heating region 114 where the fixing belt 105 is heated by the heating portion 300.

In such a constitution, the rib 122 performs the function of increasing the temperature in the neighborhood of the fixing belt 105 by covering most (the heating region 114 and a part of the region 115) of the dust generating position in FIG. 7. The rib 122 increases the particle size of the dust by the temperature increase, and thus suppresses the dust diffusion into the image forming apparatus 1. The dust increased in particle size moves upward by upward airflow (heat convection) generated at the periphery of the fixing belt 105 and deposits on the fixing belt 105 and the inside casing 112*a*. The dust deposited on the fixing belt 105 is transferred onto the sheet P, but is small in dust size and therefore has no influence on the image.

(5-1) Arrangement (Disposing Attitude, Gap G with Fixing Belt 105) of Rib 122

(5-1-1) Ambient Airflow of Fixing Belt 105

Before arrangement of the rib 122 is described, the airflow in the neighborhood of the fixing belt 105 will be described on the basis of a verification result of a hot airflow simulation shown in FIG. 10.

In this verification with respect to the heat and the airflow, it is assumed that the fixing belt 105 at a surface temperature of 170° C. is rotated in the counterclockwise direction R105 at a speed V, the pressing roller 102 is rotated in the clockwise direction R102 at the speed V, and the sheet P is moved upward in the figure at the speed V.

For that reason, in this verification, ascending airflow (CD1) due to natural convection generated at the periphery of the fixing belt 105, an airflow (RD1) at the belt surface generated with surface movement of the fixing belt 105, and an airflow 26*a* generated the sheet P with movement of the sheet P are taken into consideration.

Figure 10:
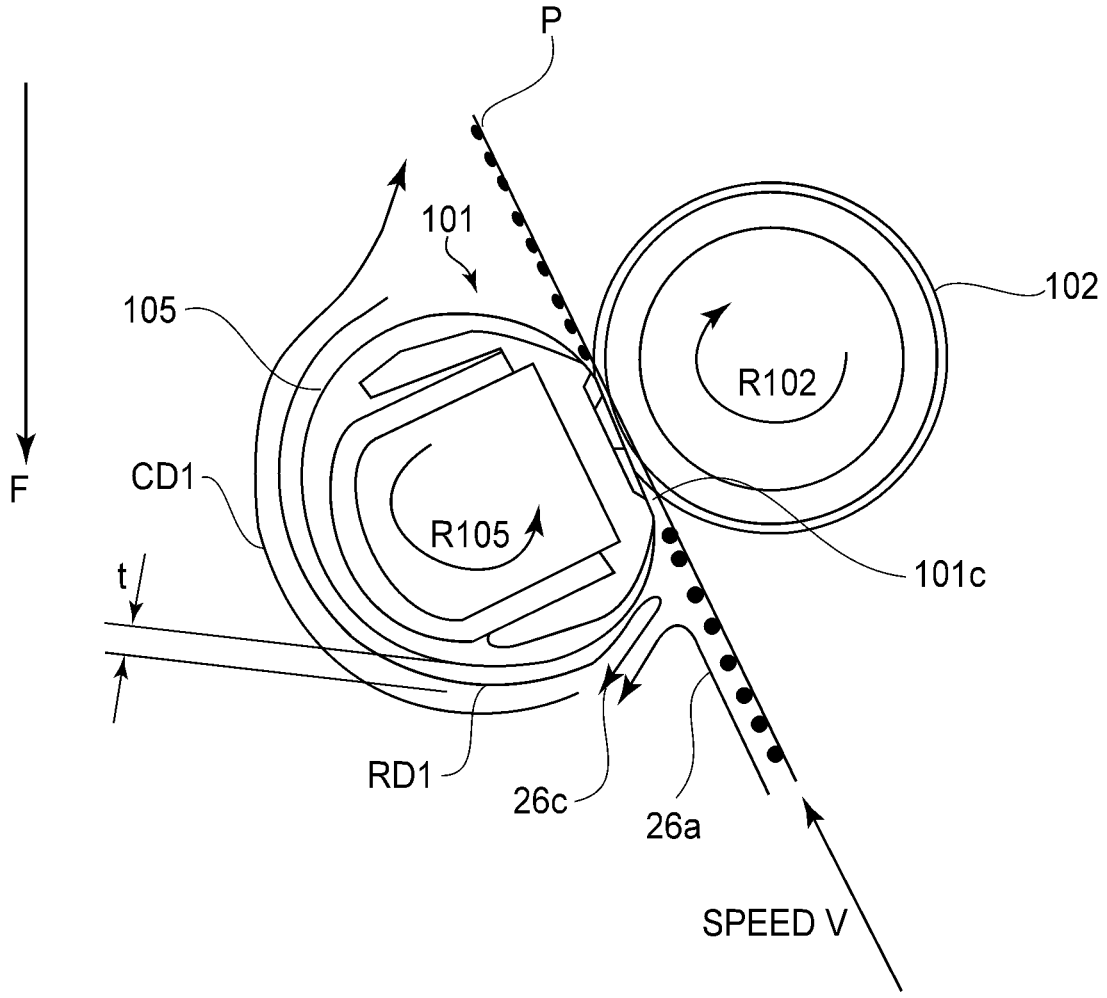
FIG. 10 is a schematic view for illustrating airflow at a periphery of the fixing belt and the pressing roller.

As shown in FIG. 10, it was confirmed that an airflow 26*c* which appears to lose a place to go at the nip entrance 101*c* and to be issued from the nip entrance 101*c* are present.

It would be considered that the airflow 26*c* is the issued air which loses the place to go as a result of collision at the nip entrance 101*c* between the airflow RD1 and the airflow 26*a*, which is generated at the sheet surface with movement of the sheet surface.

Further, the airflow 26*c* merges with the airflow RD1 to form the airflow CD1, which is adjacent to the airflow RD1 and which flows in an opposite direction to the direction of the airflow RD1, i.e., the airflow which moves upward along the surface of the fixing belt 105.

Incidentally, the airflow 26*c* was, as shown in FIG. 10, generated so as to move along the surface of the fixing belt 105, but this is presumed to be a result that the airflow is drawn by the natural convection moving upward in the neighborhood of the surface of the fixing belt 105.

(5-1-2) Action, Disposing Attitude and Gap G of Rib 122

As described above, the rib 122 has the function of increasing the temperature in the air at the periphery of the dust generating position 138 ((c) of FIG. 7). In order to ensure this temperature-increasing action (function), the airflow 26*a* resulting from the airflow 26*a* at the surface of the sheet low in temperature and the airflow CD1 have to be prevented from entering between the rib 122 and the fixing belt 105. For that reason, the rib 122 is disposed to extend from the inside casing 112*a* so as to be directed toward a downstream side of the rotational direction R105 of the fixing belt 105.

That is, the extended portion 122 is a rib portion extending from the inside casing 112*a* as the holding portion for the heating portion 300 so as to be directed toward the downstream side of the rotational direction of the fixing belt 105 as the first rotatable member. By such a constitution, the end portion 122*a* of the rib 122 can divert the airflow 26*c* and the airflow CD1 into a direction in which the airflows are moved away from the fixing belt 105.

The gap G between the end portion 122*a* of the rib 122 and the fixing belt 105 is disposed in a range of 0.5 mm or more and 3.5 mm or less, so that it is possible to ensure such an action that the airflow 26*c* and the airflow CD1 are moved away from the fixing belt 105. By setting the gap G at 3.5 mm or less, as described later, the dust density can be lowered to a value of less than 70% at a point Cl (FIGS. 1 and 6) in the neighborhood of the fixing device. Incidentally, the reason why the lower limit value is 0.5 mm is that when the diffusion suppressing mechanism is caused to further approach the surface of the fixing belt 105, there is a risk that the diffusion suppressing mechanism contacts the fixing belt 105.

(5-1-3) Effect of Rib 122

By disposing the rib 122 as described above, the dust density measured at the point C1 shown in FIG. 1 (or FIG. 6) can be suppressed to 70% or less compared with the case where there is no rib 122. There is a measurement error of 30%, and therefore as such an index that the rib 122 can be regarded as being effective, "70% or less" is set. The point C1 is set at a position of about 20 mm away from the fixing belt 105 in a path along which the dust generated from the fixing belt 105 is discharged by the ascending airflow due to the heat convection. When the dust density at the point C1 is 70% or less, it is possible to reduce the degree of contamination of the inside of the image forming apparatus with the wax in the outside of the fixing device 103.

The dust density can be measured by the above-described high-speed response type particle sizer (FMPS). Further, the measurement is made under the following condition. Specifically, under a condition such that A4-sized plain paper is fed by long edge feeding on the basis of a standard original of 5% in print ratio, fixing is continuously effected for 11 minutes. Further, for 1 minute (from after 10 minutes to 11 minutes) before end of the fixing, the dust density is measured. A measured value was obtained by averaging the dust densities in 1 minute.

Incidentally, the measuring position may also be a position of the discharging roller pair 118 or a filter 600 or the like, where the contamination with the wax is generated. This is because the dust density varies depending on the measuring position, but the effect of preventing the contamination with the wax can be estimated by the lowering rate of the dust density.

Further, in this embodiment, the dust density refers to the number density (particles/$cm^3$) of the fine particles having a particle size (diameter) in a predetermined range, i.e., the fine particles of 5.6 nm or more and 560 nm or less in particle size. That is, the number density measured at the point C1 may desirably be less than 70% of the number density in the constitution in which the rib 122 is the extended portion as employed in this embodiment, is not provided. Incidentally, as the dust density, in place of the number density (particles/$cm^3$), the weight density (μg/$m^3$) may also be employed.

In this embodiment, such a verification that when the gap G ((a) of FIG. 1) between the rib 122 and the fixing belt surface was narrowed stepwisely in the order of 4.0 mm, 3.5 mm, 2.5 mm, 2.0 mm and 1.5 mm, the dust density at the point C1 was lowered with a narrowing gap G was made. As a result, it was confirmed that when the gap G is 3.5 mm or less, the above-described condition (the dust density at the point C1: 70% or less) is satisfied.

In this embodiment, the rib 122 is provided so that the gap G is 2.5 mm. The fixing belt 105 is, as described above, formed of the belt material which is flexible and deformable, and therefore the gap G fluctuates with the rotation of the fixing belt 105. Further, a contaminant such as the paper powder deposits on the rib 122, so that the gap G is narrowed in some cases. The gap G was set at 2.5 mm as a value capable of preventing the contact between the rib 122 and the fixing belt 105 with reliability and capable of sufficiently ensuring a latitude of design to tolerance. The dust density at the point C1 when the gap G was 2.5 mm was 40% or less compared with the case where there was not rib 122.

(5-1-4) Disposition Range of Rib 122

An object of the rib 122 is to prevent the flow of the airflow 26*c* and the airflow CD1 which are shown in FIG. 10 and to increase the ambient temperature of the fixing belt 105 at the dust generating position 138 ((c) of FIG. 7). For that reason, the disposing position of the rib 122 may only be required to fall within a range of the heating region 114 and the region 115. Particularly, the rib 122 is effective when the rib 122 is disposed in a sheet introduction side in the induction heating device 300. This is because the dust is principally generated in the sheet introduction side.

It is difficult to dispose the rib 122 in the region 117 (from the contact position 116 to the nip entrance 101*c* in FIG. 6) where the sheet and the fixing belt 105 are contactable to each other since the feeding of the sheet is impaired. An area (size) of the region 117 is determined by a state of curling or bending of the leading end of the sheet entering the nip entrance 101*c*.

(5-1-5) Disposition Number of Rib 122

A plurality of ribs 122 may also be disposed in the above-described range. For example, the plurality of ribs 122 can also be provided along the rotational direction of the fixing belt with a predetermined distance therebetween (3 mm). When the plurality of ribs 122 are used, the effect of blocking the airflows 26*c* and CD1 shown in FIG. 10 is enhanced, so that the dust reducing effect can be enhanced. Incidentally, when resin molding is taken into consideration, the disposition interval may desirably be 3 mm or more but, the disposition number of the ribs 122 may also be one. That is, in this case, the gap is closed, so that a single block-like member is provided.

(5-1-6) Another Method of Determining Gap G

Figure 15:
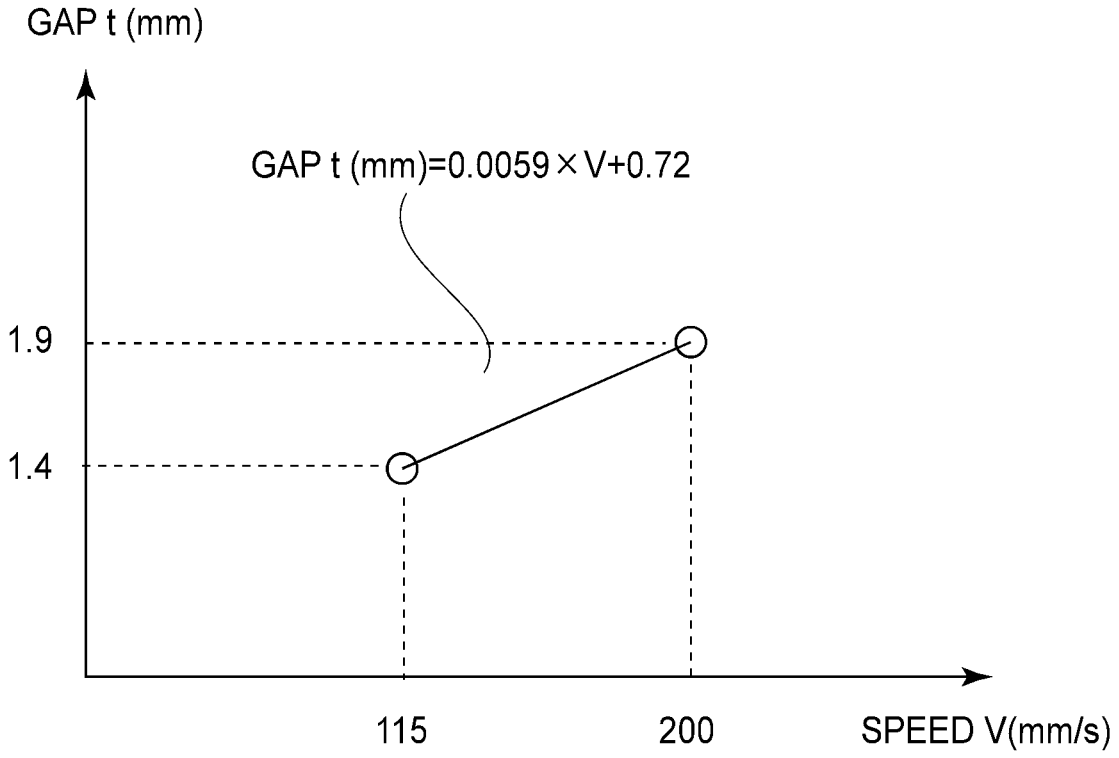
FIG. 15 is a graph showing a relationship between a gap and a peripheral speed.

The gap G may also be determined by a peripheral speed V of the fixing belt 105. In FIG. 10, t is a width of the airflow RD1. That is, t represents a distance from a boundary between the airflows RD1 and CD1 to the fixing belt 105. This width t was subjected to verification (simulation). FIG. 15 shows a result of the verification.

As shown in FIG. 15, when the surface peripheral speed V of the fixing belt 105 is 115 mm/s, t is 1.4 mm, and when the peripheral speed V is 200 m/s, t is 1.9 mm. A flow rate of the airflow RD1 along the fixing belt 105 increases with a larger surface speed (i.e., peripheral speed V) of the fixing belt 105. As a result of the increase in flow rate of the airflow RD1 by the increase in peripheral speed V, it is presumed that the value of t becomes large. When the two points shown in FIG. 15 are linearly-interpolated, the following equation is obtained.

$$t=0.0059\times V+0.72$$

When the setting is made so that the gap G exceeds the width t, the rib 122 as the suppressing portion can block the airflow CD1 with reliability. As a result, a lowering in ambient temperature of the fixing belt 105 is prevented, so that the dust can be reduced. A lower limit value of t is 0.5 mm. When the above equation and this lower limit value are combined, the range of G can be expressed by the following formula.

$$0.5\leq G\leq 0.0059\times V+0.72$$

This formula is particularly effective when the peripheral speed V of the fixing belt 105 in a range of: 115 mm/s≤V≤200 mm/s. However, a relationship between the peripheral speed V and the width t is estimated as being close to a linear relationship, and therefore the above formula is also effective even in the case where the peripheral speed V is not in the above range.

<Embodiment 2>

Figure 11:
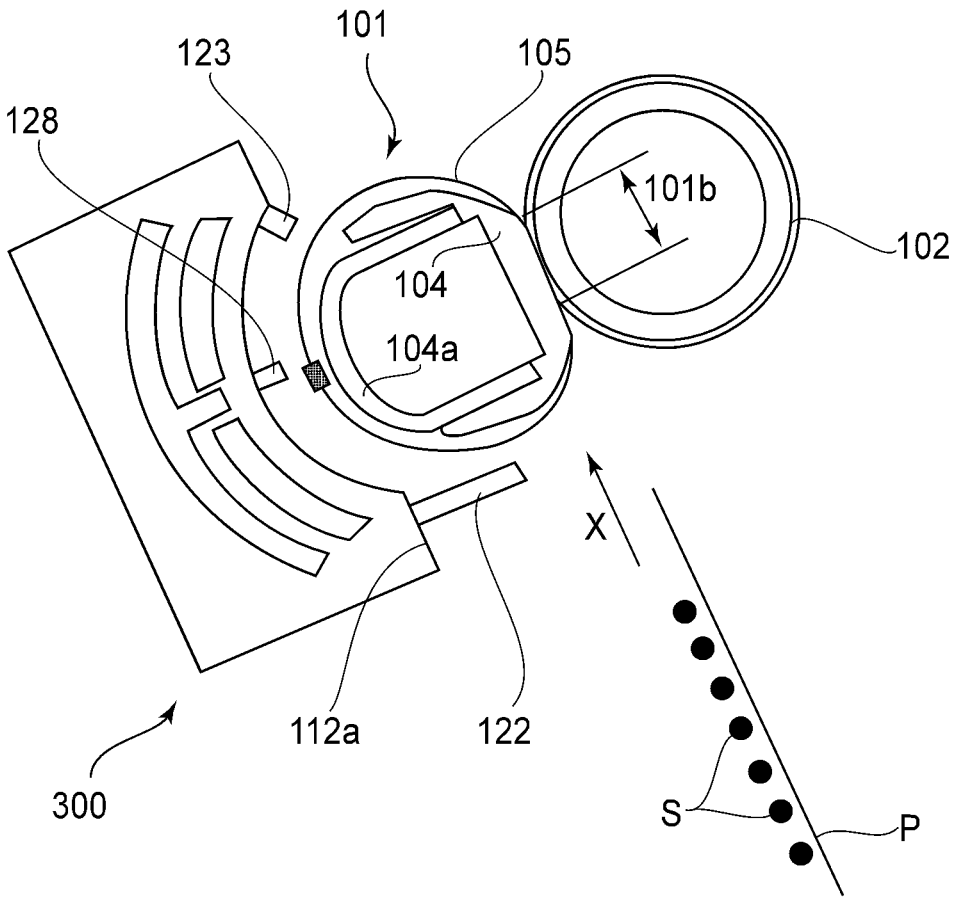
FIGS. 11 to 13 are schematic sectional views each showing a fixing device.

Next, Embodiment 2 will be described with reference to FIG. 11. Incidentally, the constitution of image forming portions and the basic constitution of a heating portion 300 in an image forming apparatus are the same as the constitutions in Embodiment 1 and a description thereof will be omitted. Further, also the mechanisms described in Embodiment 1 are represented by the same reference numerals or symbols and a detailed description thereof will be omitted.

In this embodiment, as the suppressing portion, in addition to the rib 122 described in Embodiment 1, ribs 123 and 128 are provided. By increasing the number of the ribs, it is possible to more effectively block the airflow CD1 shown in FIG. 10. As a result, the ambient temperature of the fixing belt 105 increases, so that the dust can be reduced.

<Embodiment 3>

Figure 12:
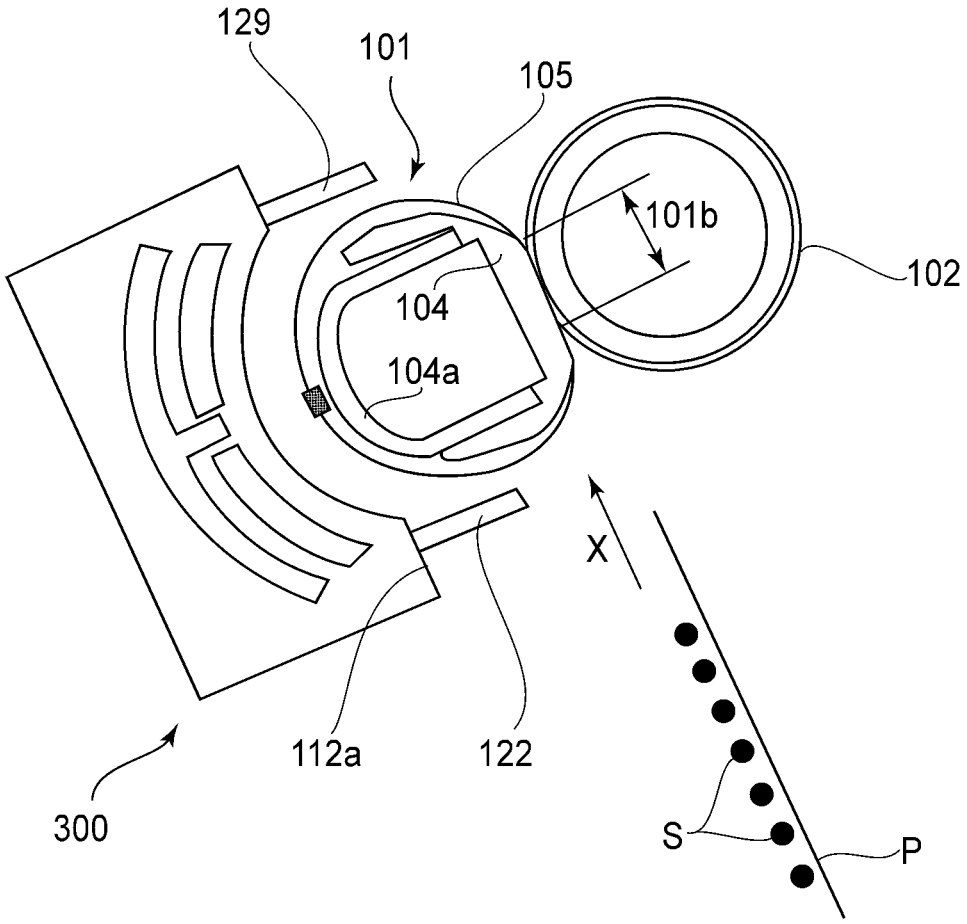

Next, Embodiment 3 will be described with reference to FIG. 12. Incidentally, the constitution of image forming portions and the basic constitution of a heating portion 300 in an image forming apparatus are the same as the constitutions in Embodiment 1 and a detailed description thereof will be omitted. Further, also the mechanisms described in Embodiment 1 are represented by the same reference numerals or symbols and a detailed description thereof will be omitted.

In this embodiment, as the extended portion, in addition to the rib 122 described in Embodiment 1, a rib 129 is provided in a sheet discharging side of the fixing belt 105. Although the rib 129 is in a position away from the dust generating position 138 shown in (c) of FIG. 7, the rib 129 has an effect of blocking the ascending airflow due to the heat convection at the periphery of the fixing belt 105. As a result, the ambient temperature of the fixing belt 105 increases, so that the dust can be reduced.

<Embodiment 4>

Figure 13:
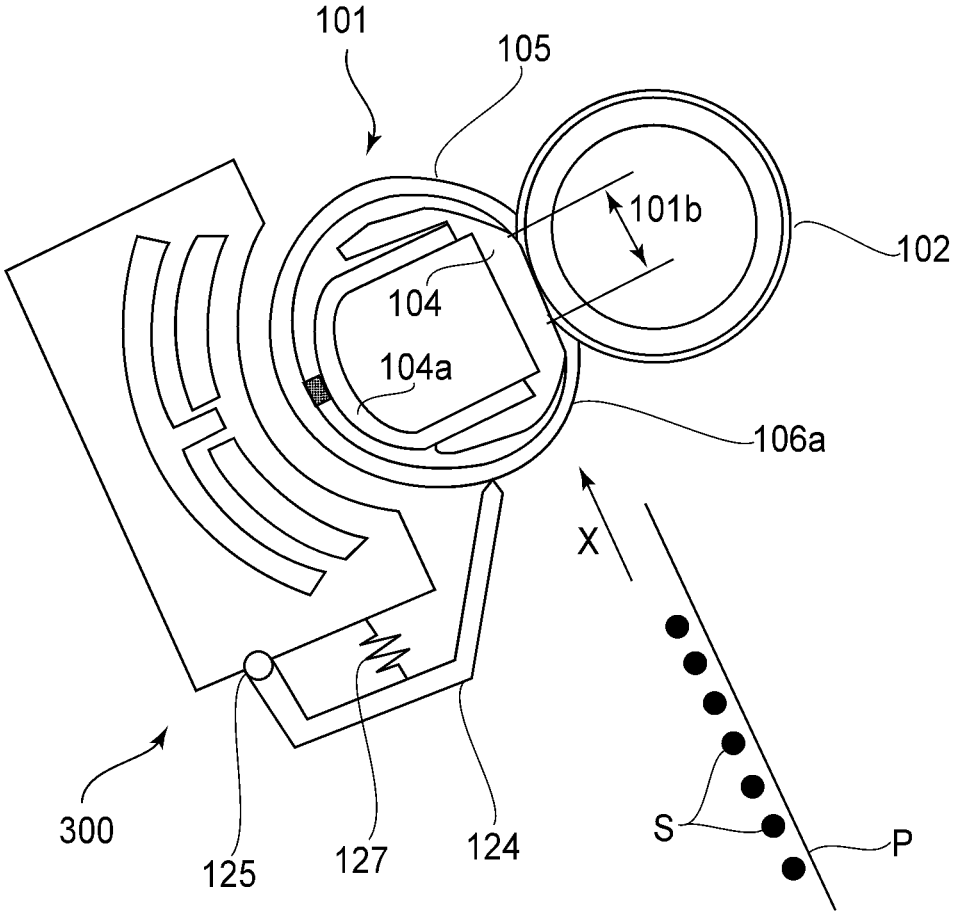
Figure 14:
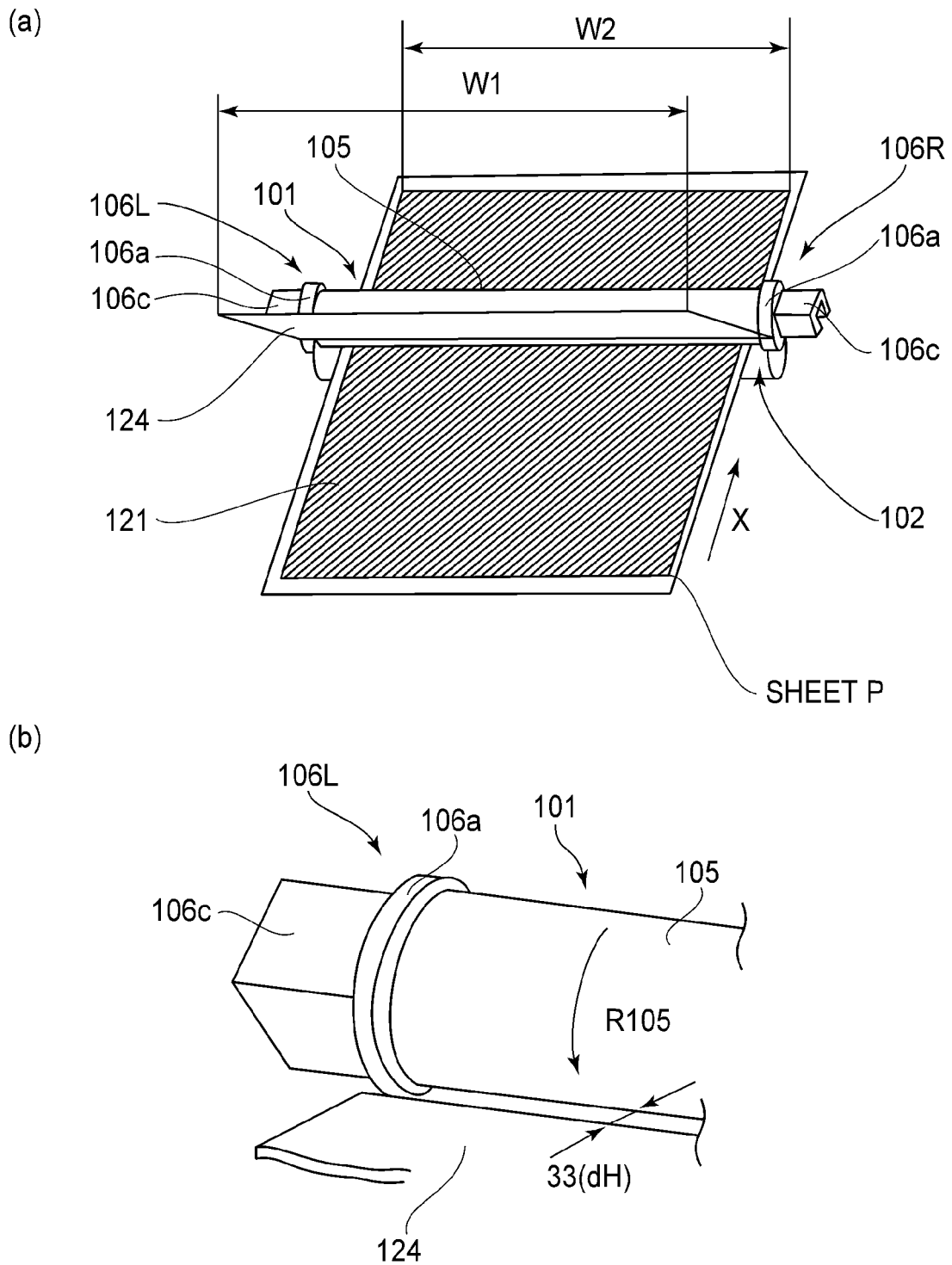
In FIG. 14, (a) and (b) are illustrations showing a rib disposing region as a suppressing portion.

Next, Embodiment 4 will be described with reference to FIGS. 13 and 14. An abutting member 123 as the extended portion is rotatable about a fulcrum 125, and is urged by a spring 127 in a direction toward the fixing belt 105. A free end of the abutting member 124 abuts against the flange portion 106*a* of each of the flanges 106L and 106R. In FIG. 14, an illustration of the induction heating device 300 is omitted. Further, the abutting member 124 is illustrated only at a part thereof.

By employing such a constitution, a gap 33 ((b) of FIG. 14) between the fixing belt 105 and the abutting member 124 as the extended portion can be controlled with high accuracy. That is, the flange portion 106*a* constitutes a spacer for controlling the gap between the fixing belt 105 and the abutting member 124 as the extended portion with high accuracy. In this embodiment, the gap 33 is a height of 1.0 mm at a stepped portion between an outer peripheral edge of the flange portion 106*a* and the surface of the fixing belt 105. The gap is set at 1.0 mm which is narrow, and therefore in this embodiment, the dust reducing effect can be further enhanced.

Further, as shown in (a) of FIG. 14, similarly as in Embodiment 1, a width W1 of the abutting member 124 is wider than a width W2 of a region in which the image is formable on the maximum width sheet. That is, a relationship of W1>W2 is satisfied.

In this embodiment, the abutting member 124 is formed of a material, such as a metal plate, which is deformed less, but in the case where there can be a risk that when the fixing belt 105, which is flexible and deformable, is deformed during rotation, the fixing belt 105 temporarily contacts the abutting member 124. In that case, the abutting member 124 may also be formed of a resin material having a high sliding property.

As described above, a constitution in which the fixing belt 105 is rotationally driven by the pressing roller was described while taking the fixing belt 105 as an example of the first rotatable member included in the fixing device. However, the present invention is not limited thereto.

For example, a constitution in which the fixing belt 105 is supported by a plurality of supporting rollers and is rotationally driven by one of these supporting rollers may also be employed.

Further, a constitution in which a fixing roller is used in place of the fixing belt 105 may also be employed.

Further, in Embodiments 1 to 4, the example in which the pressing roller 102 is used as the second rotatable member included in the fixing device is described, but for example, a constitution in which a pressing belt is used may also be employed.

Further, in the above-described embodiments, the example in which the whole of the heating portion (exciting coil, magnetic core) 300 for heating the fixing belt 105 as the first rotatable member through the electromagnetic induction heating is described, but the present invention is not limited thereto. For example, the exciting coil as a part of the electromagnetic induction heating portion is provided inside the fixing belt 105. In addition, the magnetic core as a part of the electromagnetic induction heating portion is provided outside the fixing belt 105. In this constitution, it is also possible to employ a constitution in which a holding portion (casing, holder), disposed outside the magnetic core, for supporting the magnetic core is provided with a rib as an extended member.

The holding portion for the heating portion 300 may also be a portion other than a portion which covers the entire peripheral region of the magnetic core. The holding portion may only be required to be formed in such a shape that the holding portion covers a part of the outer peripheral surface of the fixing belt as in the case of the inside casing 112*a* in Embodiment 1.

In this way, the holding portion can be in the form in which the holding portion holds only the coil included in the heating portion, the form in which the holding portion holds only the core, and the form in which the holding portion holds the coil and the core.

Further, the fixing device 103 in this embodiment is constituted so as to discharge the sheet P obliquely upward, but the present invention is also effective on a fixing device for discharging the sheet P in a vertical direction and a fixing device for discharging the sheet P in a horizontal direction.

Further, the materials for the abutting member 124 and the ribs 122, 123, 128 and 129 which are used as the extended portions may also be formed of a high heat-insulating material such as ceramics or a black material. The high heat-insulating material performs a function of confining heat in a peripheral portion of the dust generating position 138 ((c) of FIG. 7). The black material is increased in temperature by receiving radiant heat from the fixing belt 105 and thus has a function of increasing the ambient temperature of the dust generating position 138 ((c) of FIG. 7).

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-060013 filed on Mar. 24, 2014, which is hereby incorporated by reference herein in its entirety.

What is claimed is:

1. A fixing device comprising:

first and second rotatable members configured to heat-fix, at a nip therebetween, a toner image formed on a sheet by using a toner containing a parting agent;

a heating portion, provided opposed to an outer surface of said first rotatable member, configured to heat said first rotatable member through electromagnetic induction heating;

a holding portion configured to hold said heating portion; and a suppressing portion configured to suppress air flow in a space between said first rotatable member and said holding portion, wherein said suppressing portion extends from said holding portion toward said first rotatable member and is provided so that a free end portion thereof is in a position of 0.5 mm or more and 3.5 mm or less from the outer surface of said first rotatable member.

2. A fixing device according to claim 1, wherein said suppressing portion is provided at an end portion of said holding portion at a side of said device where the sheet is introduced.

3. A fixing device according to claim 2, wherein said suppressing portion extends to the outside, with respect to a widthwise direction, of a region through which an image formable region of a maximum-width-sheet usable in said fixing device passes.

4. A fixing device according to claim 1, wherein with respect to a rotational direction of said first rotatable member, the free end portion of said suppressing portion is positioned between a position where a leading end of the sheet introduced into the nip and said first rotatable member are contactable to each other and a position where the sheet is heated by said heating portion.

5. A fixing device according to claim 1, wherein said suppressing portion suppresses diffusion, toward an outside of the space, of particles of the parting agent and which have a particle size of 5.6 mm or more and 560 nm or less.

6. A fixing device according to claim 1, wherein said suppressing portion is provided at a plurality of positions with predetermined intervals therebetween along a rotational direction of said first rotatable member.

7. A fixing device according to claim 1, wherein said suppressing portion is integrally molded with said holding portion.

8. A fixing device according to claim 1, further comprising a spacer configured to maintain a gap between said suppressing portion and said first rotatable member.

9. A fixing device according to claim 1, wherein said heating portion includes at least one of an exciting coil and an exciting core.

10. A fixing device comprising:

first and second rotatable members configured to heat-fix, at a nip therebetween, a toner image formed on a sheet by using a toner containing a parting agent;

a heating portion, provided opposed to an outer surface of said first rotatable member, configured to heat said first rotatable member through electromagnetic induction heating;

a holding portion configured to hold said heating portion; and an extended portion configured to extend from said holding portion toward said first rotatable member so that a free end portion thereof is positioned a predetermined distance from a surface of said first rotatable member, wherein when a gap between said extended portion and said first rotatable member is G (mm) and a peripheral speed of said first rotatable member is V (mm/s), the following relationship is satisfied:

$$0.5 \leq G \leq 0.0059 \times V + 0.72.$$

11. A fixing device according to claim 10, wherein the following relationship is satisfied:

$$115 \leq V \leq 200.$$

12. A fixing device according to claim 10, wherein said extended portion is provided at an end portion of said holding portion at a side of said device where the sheet is introduced.

13. A fixing device according to claim 12, wherein said extended portion extends to the outside, with respect to a widthwise direction, of a region through which an image formable region of a maximum-width-sheet usable in said fixing device passes.

14. A fixing device according to claim 10, wherein with respect to a rotational direction of said first rotatable member, the free end portion of said extended portion is positioned between a position where a leading end of the sheet introduced into the nip and said first rotatable member are contactable to each other and a position where the sheet is heated by said heating portion.

15. A fixing device according to claim 10, wherein said extended portion suppresses diffusion, toward an outside of the space, of particles of the parting agent and which have a particle size of 5.6 mm or more and 560 nm or less.

16. A fixing device according to claim 10, wherein said extended portion is provided at a plurality of positions with predetermined intervals therebetween along a rotational direction of said first rotatable member.

17. A fixing device according to claim 10, wherein said extended portion is integrally molded with said holding portion.

18. A fixing device according to claim 10, further comprising a spacer configured to maintain the gap between said extended portion and said first rotatable member.

19. A fixing device according to claim 10, wherein said heating portion includes at least one of an exciting coil and an exciting core.

* * * * *